US006764142B2

(12) United States Patent
Kwon

(10) Patent No.: US 6,764,142 B2
(45) Date of Patent: Jul. 20, 2004

(54) METHOD OF MANUFACTURING A TOOTHBRUSH WITH HIGHLY TAPERED BRISTLES HAVING SUPERIOR FLEXIBILITY

(75) Inventor: Young-Jun Kwon, 4-7 Yadang-Ri, Gyoha-Myun, Gyunggi-Do, Paju (KR), 413-835

(73) Assignees: Young-Jun Kwon, Paju (KR); Best Whasung Co. Ltd., Paju (KR)

( * ) Notice: Subject to any disclaimer, the term of this patent is extended or adjusted under 35 U.S.C. 154(b) by 0 days.

(21) Appl. No.: 10/677,286

(22) Filed: Oct. 3, 2003

(65) Prior Publication Data

US 2004/0070258 A1 Apr. 15, 2004

Related U.S. Application Data

(62) Division of application No. 09/956,897, filed on Sep. 21, 2001.

(30) Foreign Application Priority Data

Feb. 23, 2001 (KR) ..... 2001-9217

(51) Int. Cl.[7] ..... A46D 1/04

(52) U.S. Cl. ..... 300/21; 15/207.2; 428/399; 428/401

(58) Field of Search ..... 300/21; 15/167.1, 15/207.2; 428/399, 401

(56) References Cited

U.S. PATENT DOCUMENTS 2,365,396 A * 12/1944 Graham ..... 451/28
2,558,334 A * 6/1951 Baumgartner ..... 15/207.2
3,830,547 A * 8/1974 Awazi et al. ..... 300/21
5,491,865 A * 2/1996 Gueret ..... 15/159.1
5,533,227 A * 7/1996 Ito et al. ..... 15/167.1
5,786,087 A * 7/1998 Cansler ..... 428/398
6,044,514 A * 4/2000 Kaneda et al. ..... 15/167.1
6,088,869 A * 7/2000 Kaneda et al. ..... 15/167.1
6,090,488 A * 7/2000 Kweon ..... 428/399

* cited by examiner

*Primary Examiner*—Mark Spisich
(74) *Attorney, Agent, or Firm*—Jacobson Holman PLLC

(57) ABSTRACT

Disclosed herein is a toothbrush with tapered bristles and method of manufacturing such toothbrushes. The toothbrush is characterized in that the tapered end of each bristle is 0.02 mm or less of diameter. The bristle is tapered starting at a position of 3.5 mm or less from an end, and is made of polyethylene terephthalate or polybutylene terephthalate. The method of this invention consists of the steps of dipping 3.5 mm portions from ends of monofilaments for toothbrushes into erosive chemicals such as sulfuric acid or sodium hydroxide until the dipped portions of the monofilaments are completely eroded, neutralizing the shortened monofilaments prior to rinsing and drying them, and implanting the shortened monofilaments on a toothbrush. Thereafter, the shortened monofilaments are ground using a 240# mesh paper at 2600 to 2700 rpm for 3 to 10 sec, a 320# mesh paper at same speed for 3 to 10 sec, and a 400# mesh paper at same speed for 3 to 10 sec. The toothbrush of this invention enjoys advantages of proper flexibility and softness, improved feeling while brushing, and excellent scaling ability.

1 Claim, 3 Drawing Sheets

PRIOR ART

PRIOR ART

METHOD OF MANUFACTURING A TOOTHBRUSH WITH HIGHLY TAPERED BRISTLES HAVING SUPERIOR FLEXIBILITY

This is a divisional application of prior application Ser. No. 09/956,897 filed on Sep. 21, 2001.

BACKGROUND OF THE INVENTION

1. Field of the Invention

The present invention relates to, in general, a toothbrush with tapered bristles and a method of manufacturing such toothbrushes, in particular, to a toothbrush with highly tapered bristles having high flexibility and a method of manufacturing the same.

2. Description of the Prior Art

A conventional monofilament for bristles of toothbrushes is made of nylon. The nylon monofilament bristles have the advantages of proper resilience and flexibility, but are disadvantageous in that they are highly water-absorbent and are easily deformed. The nylon monofilament bristles are not soft because they must be thick in order to maintain desired flexibility. Generally, the nylon monofilament bristles are each rounded at their ends in order to prevent the gums from being injured during brushing, as shown in FIG. 1.

Polyester compounds such as polybutylene terephthalate or polyethylene terephthalate, may be used as material for the monofilament bristles of toothbrushes. In comparison with nylon bristles, the polyester compound bristles have advantages of a lower price, good durability, and lower water-absorptivity, and so such polyester compounds are preferable for bristles of toothbrushes. However, the monofilament bristles made of such polyester compounds are too stiff and inferior in their flexibility, and may damage or injure the gums. The polyester compounds have been typically used as the materials for bristles of inexpensive disposable toothbrushes, or the polyester compound bristles used in combination with nylon bristles, as a way to reduce the cost.

To avoid the above disadvantages, there was proposed a process of tapering the ends of such polyester compound bristles into a needle-shape. Conventionally, such tapering of the bristles was done mechanically by the blade of a knife or an abrader, as shown in FIG. 2. But, it is almost impossible to overcome the above disadvantages of the polyester compound bristles by such mechanically and slightly tapering the ends of the bristles.

Many studies have been made to avoid such disadvantages. For example, reference may be made to a patent owned by the inventor of the present invention, Korean Patent No. 130932 (hereafter, refer to 'first prior art'), which discloses a method of tapering a monofilament for bristles using chemicals. The method disclosed in the Korean Patent comprises the steps of (i) cutting a monofilament made of polybutylene terephthalate or polyethylene terephthalate in such a way that the length of a primarily cut monofilament is longer than a target length by 1 to 4 mm, (ii) vertically dipping the surplus portion of the primarily cut monofilament into a sulfuric acid in order to remove the surplus portion of the primarily cut monofilament, in addition to tapering the end of the monofilament to form the target length of a resulting filament.

According to the first prior art, highly tapered bristles are obtained, each of which is tapered starting at a position of 4 to 10 mm from an end of the bristle, with the free end of the bristle being 0.01 mm in diameter, as shown in FIG. 3.

The first prior art provides bristles with a somewhat desired softness by reducing the stiffness of the polyester compound filaments such as polybutylene terephthalate filaments, and easily removing an odontolith from a periodontal pocket by highly tapering the end of the monofilament, as shown in FIG. 3.

However, the first prior art exhibited the following problems:

1) A toothbrush with bristles made by the method of the first prior art felt too soft by some users familiar with conventional toothbrushes with nylon bristles. Such users thus determine the brushing effect of the toothbrushes to be not desirable.

2) Since the highly tapered bristles are manufactured using chemicals, the tapering process is too difficult as the processing conditions such as a concentration of chemicals, a temperature, and the duration of dipping are difficult to precisely control. Therefore, the ends of the highly tapered bristles are not uniform. As a result, defective products are produced in 50% or more of the time.

To avoid these problems, another reference may be made to a patent owned by the inventor of the present invention, Korean Patent No. 261658 (hereafter, referred to as the 'second prior art'), which discloses a method of tapering a monofilament for the bristles of toothbrushes. This method comprises the steps of (i) primarily cutting a filament made of polybutylene terephthalate or polyethylene terephthalate into bristles having a target length, (ii) dipping the bristles into a strong alkali or acid solution at the temperature of 100 to 180° C. until the bristles shorten, (iii) rinsing the bristles with water, (iv) drying the bristles, (v) attaching the bristles on the head of a toothbrush, (vi) cutting the free ends of the bristles of the toothbrush to 0.5 to 1.5 mm, and (vii) grinding the ends of the bristles until the ends are 0.04 to 0.08 mm in diameter. A cross sectional view of a tapered bristle according to the second prior art is illustrated in FIG. 4.

Overcoming the low flexibility of the bristles according to the first prior art, the bristles of the second prior art, however, suffer from disadvantages in that it is difficult to remove the odontolith from a periodontal pocket because the diameter of the bristle ends in the second prior art, which ranges from 0.04 to 0.08 mm, is undesirably larger than that of the bristles in the first prior art, and the price of the bristles according to the second prior art is cheaper in that it is 25% of the price of the bristles in the first prior art.

SUMMARY OF THE INVENTION

It is therefore an object of the invention to avoid the disadvantages of the prior arts, and provide highly tapered bristles with appropriate flexibility suitable for preventing injury to the gums and removing an odontolith from a periodontal pocket.

It is another object of the present invention to manufacture such highly tapered bristles without wasting bristle material.

It is still another object of the present invention to provide highly tapered bristles which are comfortable to a user while toothbrushing.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

The present inventors have conducted extensive studies, resulting in the finding that the above objects could be accomplished by the provision of tapered bristles, each of which is tapered starting at a position of 3.5 mm or less from an end of the bristle, with the free end of the bristle being 0.02 mm or less in diameter.

The advantages of the invention will be described with reference to the accompanying drawings.

Figure 1:
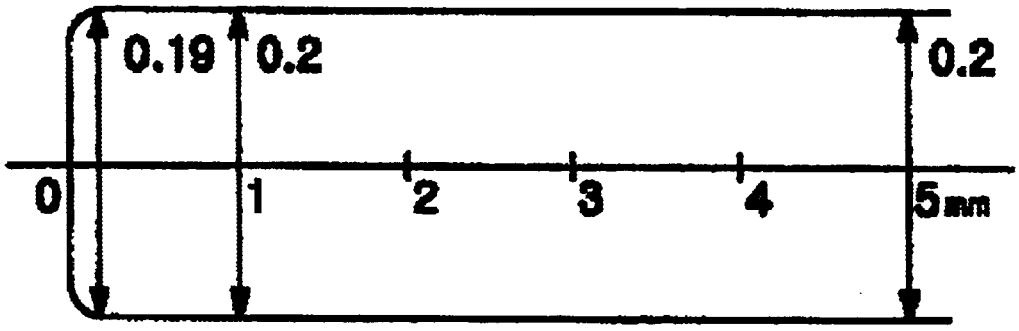
FIG. 1 is a cross sectional view of a bristle having a rounded end according to the prior art.
Figure 2:
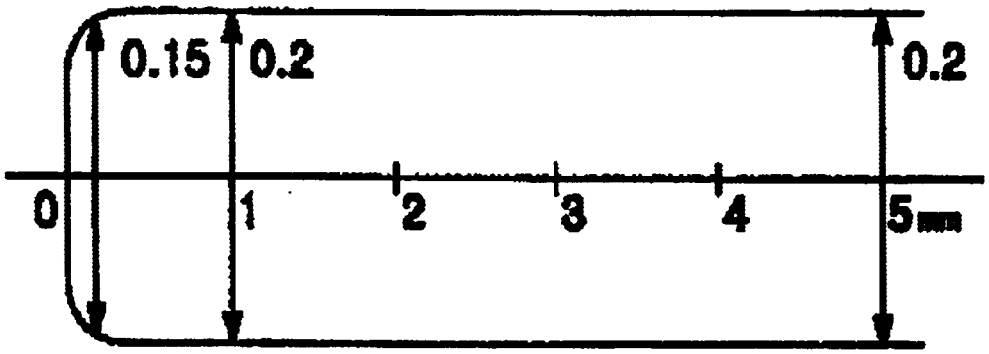
PRIOR ART Fig.2
FIG. 2 is a cross sectional view of a tapered bristle according to the prior art.
Figure 3:
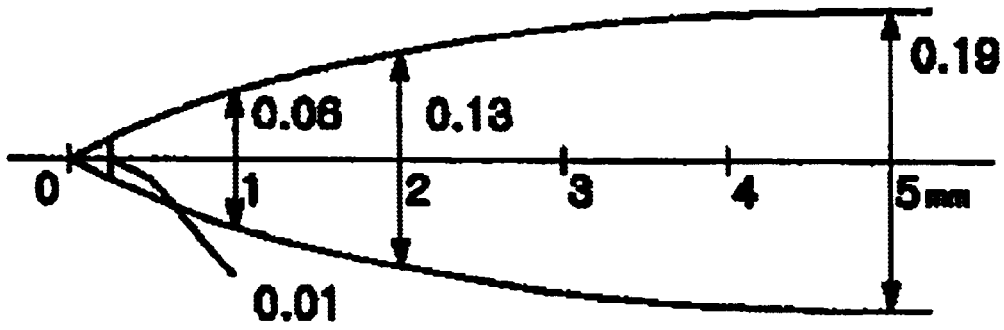
FIG. 3 is a cross sectional view of a highly tapered bristle according to the prior art.

Referring to FIG. 3 according to the first prior art, the bristles should be tapered starting at a position of 4 to 10 mm, typically 7 to 8 mm from an end of the bristle in order to allow the tapered end of the bristle to be 0.01 mm of diameter. This is because the whole bristle is eroded, not only at the ends of the bristles, when they are being dipped into chemicals, thereby reducing the flexibility of the bristles.

Figure 4:
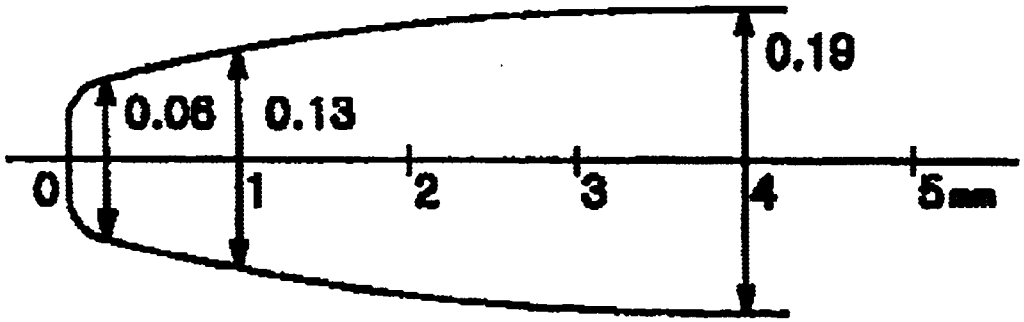
PRIOR ART Fig.4
FIG. 4 is a cross sectional view of a tapered bristle having superior flexibility according to the prior art.

With reference to FIG. 4 according to the second prior art, the bristle is tapered starting at a position of 4 to 5 mm from an end of the bristle, with the free end of the bristle being 0.04 to 0.08 mm in diameter. In comparison to the bristles with long tapered ends of first prior art, the bristles with short tapered ends according to the second prior art has increased flexibility, but it is difficult for the bristle of the second prior art to remove an odontolith from a periodontal pocket because the end of the bristle is relatively thick, as described above.

Figure 5:
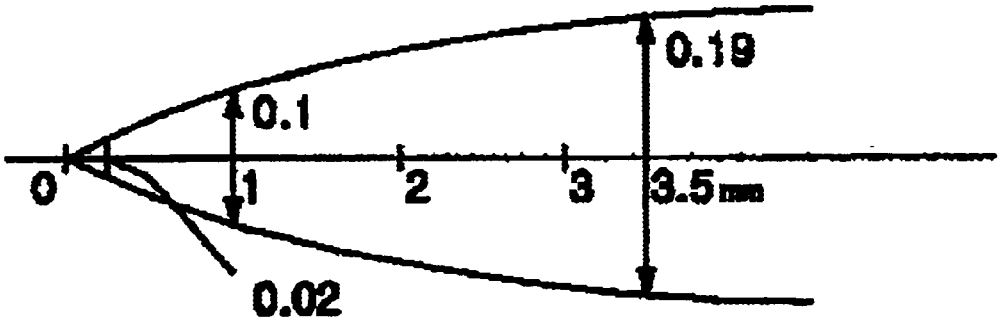
FIG. 5 is a cross sectional view of a highly tapered bristle having superior flexibility according to the present invention.

According to the present invention, tapered bristles are obtained, each of which is tapered starting at a position of 3.5 mm or less, preferably 3 mm or less from an end of the bristle, with the free end of the bristle being 0.02 mm or less, preferably 0.01 mm or less in diameter, as shown in FIG. 5.

As described above, in comparison with a bristle of first prior art, the bristle of this invention has advantages in that the odontolith can be easily removed from periodontal pockets because the end of the bristle has a small diameter. This bristle also improves the feeling while brushing because it is better than that of the second prior art in flexibility. Furthermore, a thin end of this bristle provides softness, so that the bristles are less likely to cause damage to the gums while toothbrushing. Accordingly, the bristles of the invention can overcome the disadvantages of the prior arts.

A method of manufacturing the bristles of the invention, comprises the steps of dipping a portion of 3.5 mm length from an end of a monofilament for bristles into erosive chemicals such as sulfuric acid or sodium hydroxide until the dipped portion of the monofilament is completely eroded; neutralizing the shortened monofilament prior to rinsing and drying it; implanting such shortened monofilaments on the head of a toothbrush; and grinding the implanted monofilaments with a 240# mesh paper at 2600 to 3000 rpm for 3 to 10 sec, a 320# mesh paper at same speed for 3 to 10 sec, and a 400# mesh paper at same speed for 3 to 10 sec, thus forming the resulting bristles.

Thereby, tapered bristles with each free end ranging from 0.005 mm to 0.02 mm in diameter are obtained, each of which are tapered starting at a position of 2.8 mm to 3.5 mm from the base end of the bristle, without wasting materials.

The following examples are for illustration purposes only and in no way limit the scope of this invention.

EXAMPLE

Into a 1,000 ml beaker with a sandbath were charged 50% NaOH solution filled 1 cm from the bottom of the beaker. Then, the temperature of the solution was increased to 120° C. After that, polybutylene terephthalates (520) filament 0.2 mm in diameter, manufactured by TORAY CO., Japan, were cut into filaments 30 mm in length. Thereafter, 3.5 mm end portions of the bundled filaments were dipped vertically into the NaOH solution. After 18 minutes passed from the start of dipping, the ends of the filaments were not at the point of melting so filaments were not shortened, but after 19 minutes from the start of the dipping, the ends of the filaments were at the point of melting so that the filaments were shortened. After 19 minutes had passed from the start of dipping, the tapered filaments were removed from the solution. Subsequently, the opposite ends of the filaments were tapered in the same manner as described above, thus producing bristles.

Afterward, highly tapered filaments, each of which was tapered starting at a position of 3.0 mm from an end of the filament with the end being 0.01 mm in diameter, were obtained by the steps of fully rinsing the filament bundles with water; drying the bundles after binding the filaments with a rubber band; attaching the filaments on the head of a toothbrush; and grinding the filaments by use of a cutting and grinding machine with a 240# mesh paper rotated at 2700 rpm for 5 sec., a 320# mesh paper at the same speed for 5 sec., and a 400# mesh paper at the same speed for 5 sec.

After 10 adults brushed their teeth with the use of the resulting toothbrushes, the toothbrushes were evaluated as excellent toothbrushes in regard with flexibility, softness, feeling while brushing, and scaling ability.

Comparative Example

The procedure of the above Example was repeated except that the dipping time was set to 18 minutes and the step of grinding with the use of a 320# mesh paper was omitted.

Tapered filaments with the end being 0.04 mm in diameter were obtained, each of which was tapered starting at a position of 3.5 mm from an end of the filament.

After 10 adults brushed their teeth with the use of the resulting toothbrushes, the toothbrushes were evaluated lowly in comparison with those of Example in regard with flexibility, softness, feeling while brushing, and scaling ability.

As described above, the toothbrush of the invention provides proper flexibility and softness, and easily removes an odontolith from a periodontal pocket, with bristles creating a good feeling for the user while brushing. Also, the toothbrush of the present invention prevents waste of materials and reduces the defective proportion of products during production of toothbrushes, different from toothbrushes having conventional highly tapered bristles.

Although the Examples of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method of manufacturing a toothbrush with highly tapered bristles having superior flexibility, comprising the steps of:

dipping 3.5 mm-long portions from ends of monofilaments for bristles into erosive chemicals such as sulfuric acid or sodium hydroxide until the dipped portions of the monofilaments are completely eroded;

neutralizing the shortened monofilaments prior to rinsing and drying them;

attaching the shortened monofilaments on a predetermined portion of a toothbrush; and grinding the shortened monofilaments with the use of a 240# mesh paper rotated at 2600 to 2700 rpm for 3 to 10 sec, a 320# mesh paper rotated at same speed for 3 to 10 sec, and a 400# mesh paper rotated at same speed for 3 to 10 sec.

* * * * *